US010189060B2

(12) United States Patent
Hsu

(10) Patent No.: US 10,189,060 B2
(45) Date of Patent: Jan. 29, 2019

(54) CABLE FEEDING DEVICE FOR DRAIN CLEANER

(71) Applicant: SDY International Co., Ltd., Taichung (TW)

(72) Inventor: Wei-Tien Hsu, Taichung (TW)

(73) Assignee: SDY International Co., Ltd., Taichung (TW)

( * ) Notice: Subject to any disclaimer, the term of this patent is extended or adjusted under 35 U.S.C. 154(b) by 358 days.

(21) Appl. No.: 15/133,395

(22) Filed: Apr. 20, 2016

(65) Prior Publication Data

US 2017/0304879 A1 Oct. 26, 2017

(51) Int. Cl.
*B08B 9/04* (2006.01)
*E03F 9/00* (2006.01)

(52) U.S. Cl.
CPC ..... *B08B 9/04* (2013.01); *E03F 9/005* (2013.01)

(58) Field of Classification Search
CPC ..... B08B 9/04; B08B 9/045; E03F 9/005
USPC ..... 15/104.33
See application file for complete search history.

(56) References Cited

U.S. PATENT DOCUMENTS 2,769,191 A * 11/1956 Hunt ..... E03F 9/005 15/104.33
5,029,356 A * 7/1991 Silverman ..... E03F 9/005 15/104.33
5,640,736 A * 6/1997 Salecker ..... B08B 9/045 15/104.31
5,901,401 A * 5/1999 Rutkowski ..... E03F 9/005 15/104.31
6,158,076 A 12/2000 Rutkowski
6,343,398 B1 * 2/2002 Silverman ..... B08B 9/045 15/104.31
6,470,525 B1 * 10/2002 Silverman ..... B08B 9/045 15/104.33
6,615,436 B1 * 9/2003 Burch, Jr. ..... B08B 9/045 15/104.05
7,367,077 B2 * 5/2008 Rutkowski ..... B08B 9/045 15/104.31
7,478,451 B2 * 1/2009 Rutkowski ..... B08B 9/045 15/104.31
2016/0175899 A1 * 6/2016 Dunkin ..... E03F 9/005 15/104.33

* cited by examiner

*Primary Examiner* — Weilun Lo
(74) *Attorney, Agent, or Firm* — Alan D. Kamrath; Kamrath IP Lawfirm, P.A.

(57) ABSTRACT

A cable feeding device for a drain cleaner includes an upper body mounted on a support tube of the drain cleaner, a control subassembly, and a lower body. The upper body in which an upper feeding roller is held and the lower body in which two lower feeding rollers are held join each other, so that a cable inside a cable drum of the drain cleaner can extend through a region encircled with the upper and lower feeding rollers and can be resisted by the upper and lower feeding rollers for controllable forward or backward movements of the cable into a drain to be cleaned. The lower body has at least one separate mold-stripping hole for easy manufacturing of the upper and lower bodies in a plastic injection molding process. The upper and lower feeding rollers are not exposed to the outside for longer service life to hold the cable.

9 Claims, 5 Drawing Sheets

CABLE FEEDING DEVICE FOR DRAIN CLEANER

BACKGROUND OF THE INVENTION

1. Field of the Invention

The present invention relates to a cable feeding device and, more particularly, to an automatic cable feeding device for a drain cleaner.

2. Description of the Related Art

Feed control devices for hand operated drain cleaning tools disclosed in U.S. Pat. No. 6,158,076 includes a cable drum provided with a crank arm, a cable received in the cable drum, a drum support joining at the front of the cable drum, and a cable feeding device mounted on a front end of the drum support. The drum support is made of plastic material and includes a support tube. The cable has an inner end coiled in the cable drum and an outer end extending through the support tube and outwardly beyond the front end of the drum support. The cable feeding device includes an actuator arm, a drive roller mounted on a lower side of the support tube, and two actuator rollers mounted on the actuator arm. The actuator arm includes a circular skirt portion, a front wall, and a trigger by which the actuator rollers are activated and displaced in a radial direction and resist the cable. When the crank arm is activated for rotations, the cable is held with the drive roller and the actuator rollers and controllably moved forward or backward.

However, the three feed rollers of the cable feeding device, which is partially effective in some applications, are exposed on the exterior of the cable feeding device and easily damaged, so that the held cable may suffer from negative effects. Moreover, the structure of the cable feeding device is not only unfavorable to mold stripping in a plastic molding process but also inconveniently manufactured and more or less expensive for its major components.

BRIEF SUMMARY OF THE INVENTION

Thus, an objective of the present invention is to provide a cable feeding device for a drain cleaner to improve the aforementioned problems. The cable feeding device of the present invention features major components manufactured in plastic injection molding processes easily and features feeding rollers not exposed to the outside for longer service life and effect of holding a cable.

To achieve this and other objectives, a cable feeding device for a drain cleaner of the present invention includes an upper body, a control subassembly, and a lower body. The drain cleaner includes a cable drum, a cable received in the cable drum, and a support tube joining at a front end of the cable drum. The upper body is adapted to be mounted on the support tube of the drain cleaner and includes an outside surface and an inside surface that defines an upper holding space. A raised connecting tube is provided on the outside surface of the upper body and has an inner bore in communication with a through-hole formed in the upper body. The control subassembly includes a mounting pillar, an upper feeding roller, and an operating member. The mounting pillar is moveably received in the connecting tube and includes a lower end and an upper end. The lower end of the mounting pillar extends through the through-hole of the upper body and into the upper holding space of the upper body, and the upper end of the mounting pillar is located in the inner bore of the connecting tube. The upper feeding roller is mounted on the lower end of the mounting pillar. The operating member is moveably mounted on the connecting tube and includes a resisting pillar at a bottom thereof to press the upper end of the mounting pillar. The lower body is combined with the upper body and includes an outside surface and an inside surface that is opposite to the inside surface of the upper body and defines a lower holding space. Two support bases are provided on the inside surface of the lower body, and two lower feeding rollers are respectively mounted on the support bases and located in the lower holding space. The cable extends through a region encircled with the upper and lower feeding rollers and can be held or released by the upper and lower feeding rollers.

In a preferred form, the lower body has a separate mold-stripping hole therein adjacent to one side of each of the support bases. The upper body is a shell body with a semi-circular section and the lower body is a shell body with a semi-circular section. The upper and lower bodies are respectively includes a plurality of connecting holes therein, and a plurality of screws respectively penetrate the connecting holes of the upper body as well as the connecting holes of the lower body.

In a preferred form, the cable feeding device further includes an elastic component received in the inner bore of the connecting tube and between the operating member and the mounting pillar.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
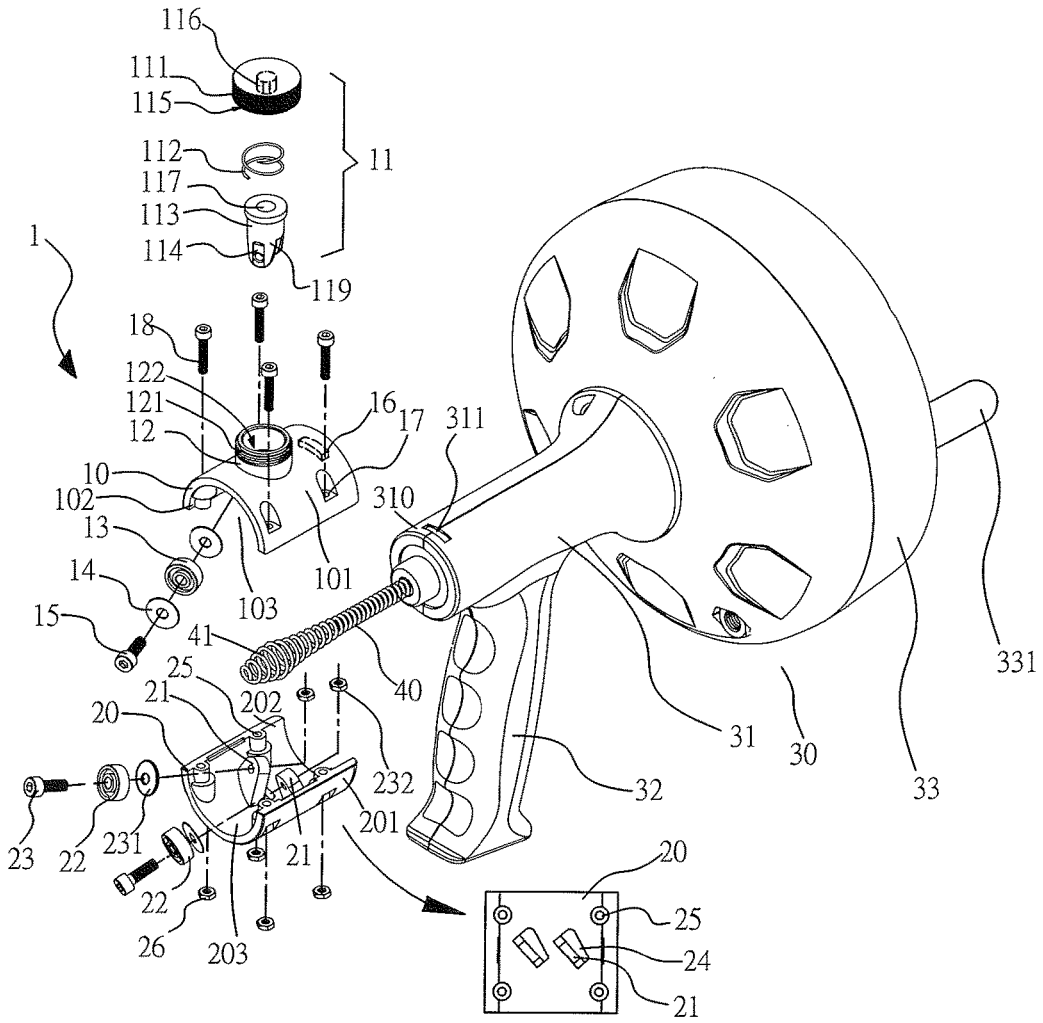
FIG. 1 is an exploded, perspective view of a drain cleaner including a cable feeding device of the present invention.
Figure 2:
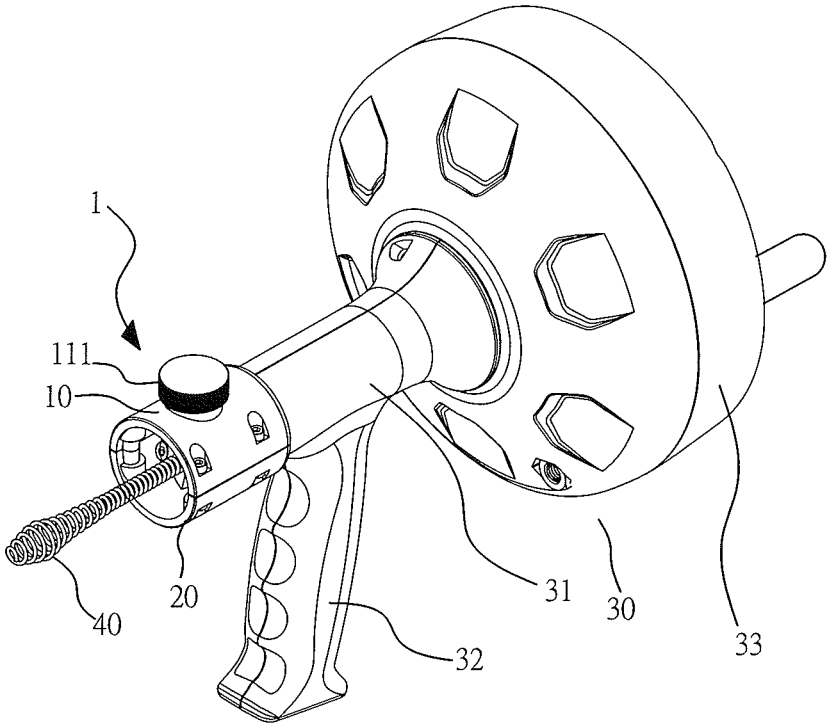
FIG. 2 is a perspective view of the drain cleaner of FIG. 1.
Figure 3:
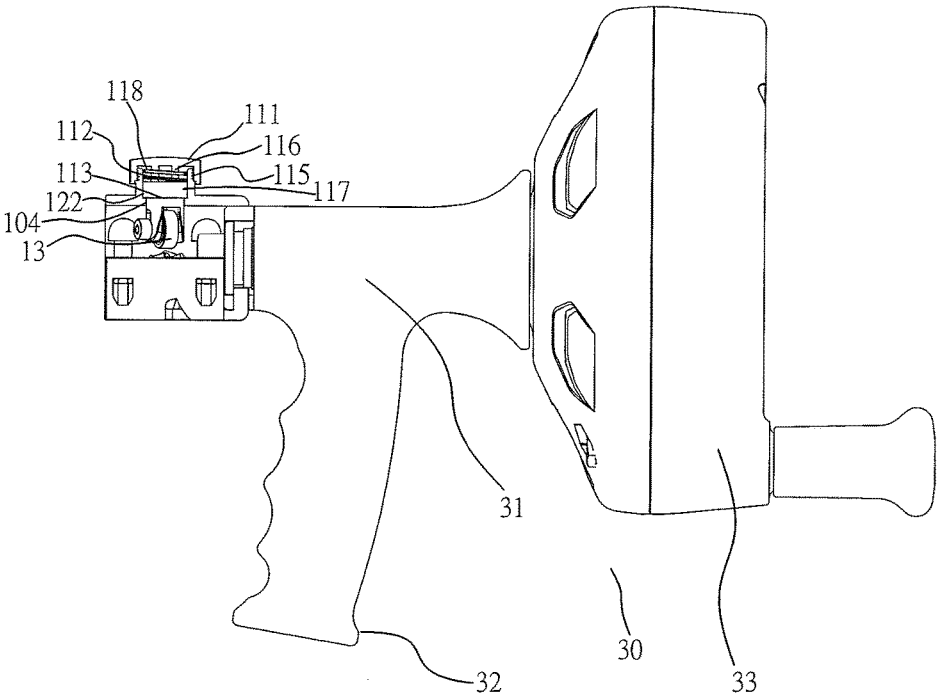
FIG. 3 is a schematic view of the drain cleaner in FIG. 2 with a cable of the drain cleaner removed, illustrating a structure of the cable feeding device of the present invention.
Figure 4:
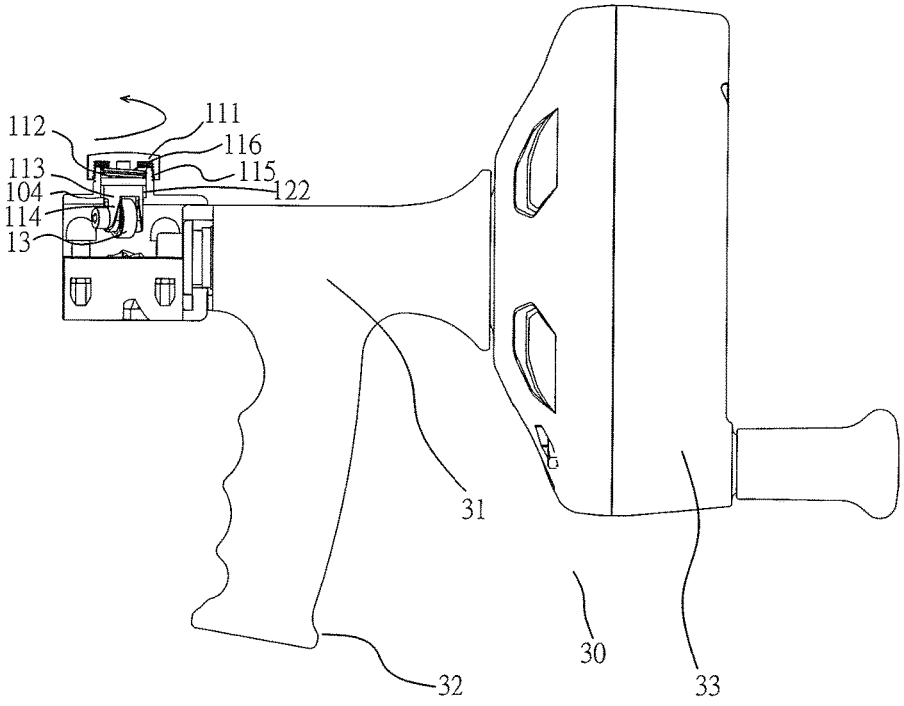
FIG. 4 is a schematic view similar to FIG. 3, illustrating an operating member of a control subassembly activated.

A drain cleaner 30 including a cable feeding device 1 of the present invention is shown in FIGS. 1 through 4 of the drawings. The drain cleaner 30 further includes a cable drum 33, a cable 40, and a support tube 31 joining at a front end of the cable drum 33. The cable drum 33 is provided with a crank arm 331 on a rear side thereof. A handle 32 is provided on a lower side of the support tube 31 and adapted to be held by an operator, and a mounting hole 311 is formed in a front end 310 of the support tube 31 for connecting with the cable feeding device 1. The cable 40 which is partially received in the cable drum 33 includes an outer end 41 extending through the support tube 31 and outwardly beyond the front end 310 of the support tube 31.

The cable feeding device 1 includes an upper body 10, a control subassembly 11, and a lower body 20. The upper body 10, which is a shell body with a semi-circular section, includes an outside surface 101 and an inside surface 102 that defines an upper holding space 103. The upper body 10 includes a snap-fit portion 16, which is located at a rear side of the inside surface 102 and fastened in the mounting hole 311 of the support tube 31, for fixing the cable feeding device 1 at the front end 310 of the support tube 31. The upper body 10 further includes a connecting tube 12 protruding from the outside surface 101 of the upper body 10. The connecting tube 12 is provided with external threads 121 on an exterior thereof and has an inner bore 122 which is in communication with a through-hole 104 in the upper body 10 (see FIG. 3). In this embodiment, the inner bore 122 is greater than the through-hole 104 in diameter for development of a stepped portion (with no number assigned) at a bottom of the inner bore 122. Moreover, the upper body 10 further includes a plurality of connecting holes 17 therein.

The control subassembly 11 includes a mounting pillar 113, an upper feeding roller (upper bearing) 13, and an operating member 111. The mounting pillar 113 is moveably received in the inner bore 122 of the connecting tube 12. The mounting pillar 113 includes a lower end 119 with two spaced clamp arms 114 and an upper end 117. When the mounting pillar 113 is received in the inner bore 122 of the connecting tube 12, the clamp arms 114 of the mounting pillar 113 penetrate the through-hole 104 of the upper body 10 and stay in the upper holding space 103 of the upper body 10, with the upper end 117 of the mounting pillar 113 located in the inner bore 122 of the connecting tube 12 and abutting the stepped portion at the bottom of the inner bore 122. The upper feeding roller 13 is mounted between the clamp arms 114 of the mounting pillar 113 and fixed with a screw 15 and washers 14. The operating member 111 is mounted on the connecting tube 12 and includes a resisting pillar 116 at a bottom thereof to press the upper end 117 of the mounting pillar 113. An elastic component 112 is received in the inner bore 122 of the connecting tube 12 and between the operating member 111 and the mounting pillar 113. A holding chamber 118 is defined between the resisting pillar 116 and a peripheral wall of the operating member 111 for accommodating the elastic component 112 inside (see FIG. 3). Moreover, the operating member 111 has internal threads 115 on an inner face of the peripheral wall thereof to engage with the external threads 121 of the connecting tube 12, so that the operating member 111 can be rotated to move inwardly or outwardly relative to the connecting tube 12. When the operating member 111 is activated for rotations, the elastic component 112 is compressed for generation of adjustable force applied on the mounting pillar 113, so that the upper feeding roller 13 is shifted in a radial direction of the upper body 10.

The lower body 20, which is a shell body with a semi-circular section, includes an outside surface 201 and an inside surface 202 that defines a lower holding space 203. The lower body 20 and the upper body 10 match and join each other with the inside surface 202 of the lower body 20 opposite to the inside surface 102 of the upper body 10. In this embodiment, the lower body 20 having a plurality of connecting holes 25 joins the upper body 10 to become a circular housing when screws 18 penetrating the connecting holes 17 of the upper body 10 as well as the connecting holes 25 of the lower body 20 are fastened with nuts 26. Two support bases 21 are provided on the inside surface 202 of the lower body 20 for installation of two lower feeding rollers (lower bearings) 22 which are respectively fixed on the support bases 21 with screws 23, washers 231 and nuts 232 but not rubbed excessively because of existence of the washers 231. The lower feeding rollers 22 inside the lower holding space 203 of the lower body 20 and the upper feeding roller 13 inside the upper body 10 are arranged as an equilateral triangle approximately, so that the cable 40 extends through a region encircled with the three feeding rollers 13, 22 and can be held or released by the three feeding rollers 13, 22. In this embodiment, the upper and lower bodies 10 and 20 are curved components, and each of the support bases 21 is obliquely situated on the lower body 20. Furthermore, the lower body 20 has a separate mold-stripping hole 24 therein adjacent to one side of each of the support bases 21 for convenient plastic molding based on a mold and easy manufacturing of the upper and lower bodies 10 and 20 in a plastic injection molding process. The upper and lower bodies 10 and 20 can be fabricated with plastic raw materials or metal powders in an injection molding process.

In the cable feeding device 1, the operating member 111 can be operated for generation of adjustable force applied on the mounting pillar 113 and further on the cable 40 which is subject to the upper feeding roller 13 shifted in a radial direction of the upper body 10. With the crank arm 331 activated for rotations, the cable 40 is resisted or held by the upper and lower feeding rollers 13 and 22 for controllable forward or backward movements of the cable 40 into a drain to be cleaned without a manual operation to respectively draw and retract the cable 40 from and into the cable drum 33. On the other hand, when the cable 40 inside the drain to be cleaned is jammed and needs to be drawn manually, the operating member 111 should be enabled reversely for no force applied on the cable 40 by the upper feeding roller 13. Moreover, the upper and lower feeding rollers 13 and 22 received in the upper and lower bodies 10 and 20 of the cable feeding device 1 are not exposed to the outside for longer service life to hold the cable 40.

Figure 5:
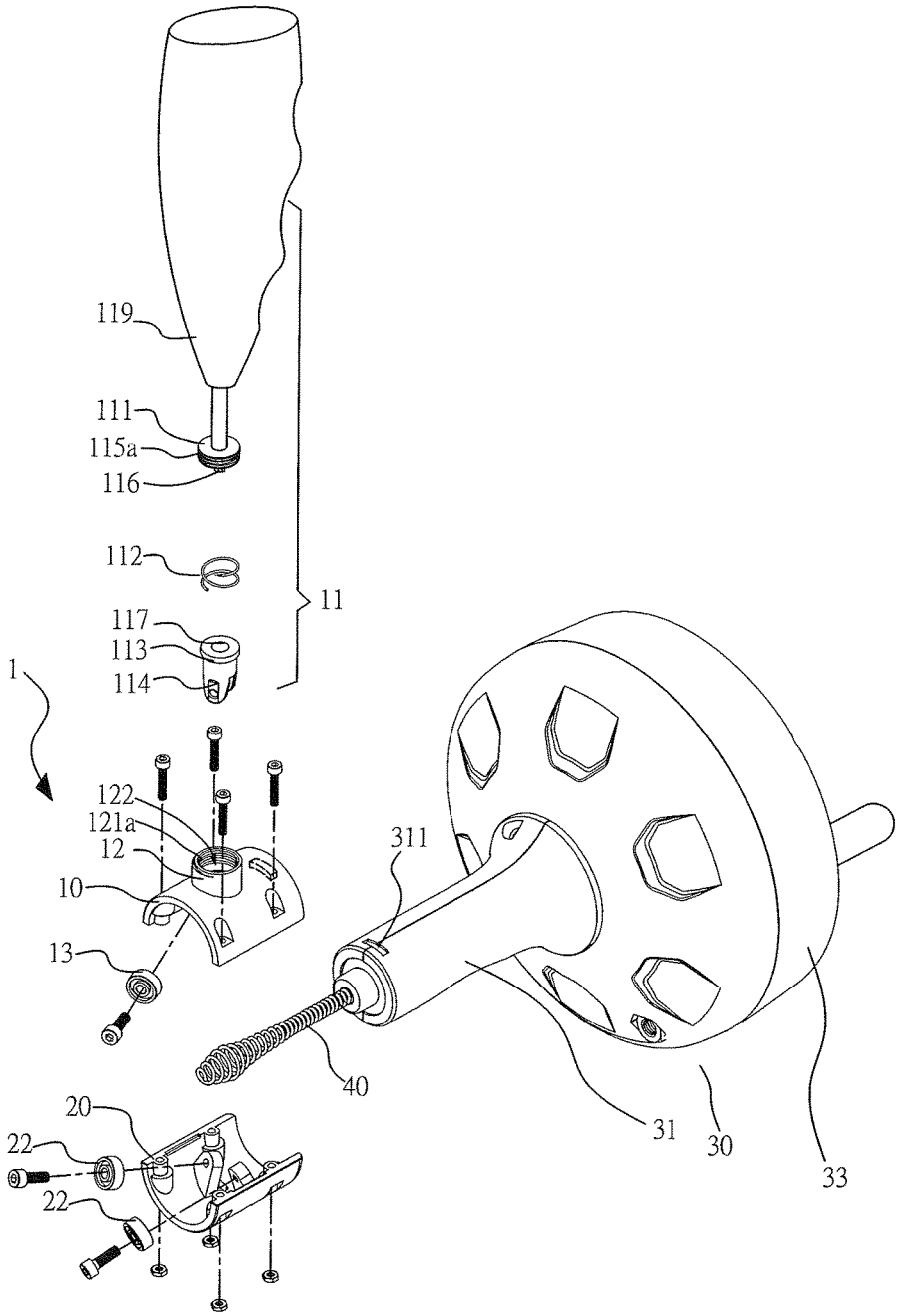
FIG. 5 is an exploded, perspective view similar to FIG. 1, illustrating a cable feeding device according to another embodiment of the present invention.

FIG. 5 illustrates a cable feeding device 1 according to another embodiment of the present invention. In this embodiment, internal threads 121*a* are formed around an inner wall of the connecting tube 12 of the upper body 10, and external threads 115*a* are formed around the peripheral wall of the operating member 111 for engaging with the internal threads 121*a* of the connecting tube 12. Furthermore, the operating member 111 is provided with a grab handle 119 on the top thereof. The grab handle 119 is adapted to be held by an operator to rotate the operating member 111 to control force applied on the cable 40. In virtue of the grab handle 119, the handle 32 in FIG. 1 can be cancelled for convenient operation of the cable feeding device 1 by the operator.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A cable feeding device for a drain cleaner, the drain cleaner including a cable drum, a cable received in the cable drum, and a support tube joining at a front end of the cable drum, with the cable feeding device comprising:

an upper body adapted to be mounted on the support tube of the drain cleaner, with the upper body including an outside surface and an inside surface that defines an upper holding space, with a raised connecting tube provided on the outside surface of the upper body and having an inner bore in communication with a through-hole formed in the upper body;

a control subassembly including a mounting pillar, an upper feeding roller, and an operating member, with the mounting pillar moveably received in the connecting tube, with the mounting pillar including a lower end and an upper end, with the lower end of the mounting pillar extending through the through-hole of the upper body and into the upper holding space of the upper body, with the upper end of the mounting pillar located in the inner bore of the connecting tube, with the upper feeding roller mounted on the lower end of the mounting pillar, with the operating member threadedly engaged on the connecting tube and including a resisting pillar at a bottom thereof to press the upper end of the mounting pillar; and a lower body detachably combined with the upper body and including an outside surface and an inside surface that is opposite to the inside surface of the upper body and defines a lower holding space, with two support bases provided on the inside surface of the lower body, with two lower feeding rollers respectively mounted on the two support bases and located in the lower holding space, wherein the cable extends through a region encircled with the upper and lower feeding rollers and can be held or released by the upper and lower feeding rollers, wherein the upper and lower bodies respectively include a plurality of connecting holes therein, with a plurality of screws respectively penetrating the connecting holes of the upper body as well as the connecting holes of the lower body to combine the upper and lower bodies, wherein the lower body has a separate mold-stripping hole therein adjacent to one side of each of the two support bases for manufacturing of the upper and lower bodies in plastic injection molding processes.

2. The cable feeding device according to claim 1, wherein the upper body is a shell body with a semi-circular section and the lower body is a shell body with a semi-circular section.

3. The cable feeding device according to claim 2, wherein the upper body includes a snap-fit portion at a rear side of the inside surface of the upper body, with the snap-fit portion adapted to be fastened in a mounting hole in the support tube.

4. The cable feeding device according to claim 1, further comprising:

an elastic component received in the inner bore of the connecting tube and between the operating member and the mounting pillar.

5. The cable feeding device according to claim 4, wherein the connecting tube is provided with external threads on an exterior thereof, with the operating member having internal threads on a peripheral wall thereof for engaging with the external threads of the connecting tube, wherein the elastic component is compressed for generation of adjustable force applied on the mounting pillar when the operating member is activated for rotations.

6. The cable feeding device according to claim 4, wherein the connecting tube is provided with internal threads around an inner wall of the connecting tube, with the operating member having external threads formed around a peripheral wall thereof for engaging with the internal threads of the connecting tube, wherein the elastic component is compressed for generation of adjustable force applied on the mounting pillar when the operating member is activated for rotations.

7. The cable feeding device according to claim 1, wherein a grab handle is provided on a top of the operating member.

8. The cable feeding device according to claim 1, wherein the mounting pillar includes two spaced clamp arms at the lower end thereof, with the upper feeding roller mounted between the two clamp arms.

9. The cable feeding device according to claim 1, wherein the inner bore of the connecting tube is greater than the through-hole of the upper body in diameter for development of a stepped portion at a bottom of the inner bore, with the upper end of the mounting pillar abutting the stepped portion.

* * * * *